US007487625B2

(12) United States Patent
Natterer et al.

(10) Patent No.: US 7,487,625 B2
(45) Date of Patent: Feb. 10, 2009

(54) METHOD AND DEVICE FOR PACKAGING

(75) Inventors: Hans Natterer, Legau (DE); Helmut Sparakowski, Tannheim (DE)

(73) Assignee: Multivac Sepp Haggenmuller GmbH & Co. KG (DE)

( * ) Notice: Subject to any disclaimer, the term of this patent is extended or adjusted under 35 U.S.C. 154(b) by 547 days.

(21) Appl. No.: 10/518,346

(22) PCT Filed: May 14, 2003

(86) PCT No.: PCT/EP03/05061

§ 371 (c)(1),
(2), (4) Date: Dec. 17, 2004

(87) PCT Pub. No.: WO04/000650

PCT Pub. Date: Dec. 31, 2003

(65) Prior Publication Data

US 2005/0173289 A1 Aug. 11, 2005

(30) Foreign Application Priority Data

Jun. 20, 2002 (DE) ..... 102 27 610

(51) Int. Cl.
*B65B 31/00* (2006.01)
*B65B 47/02* (2006.01)
*B65B 25/06* (2006.01)

(52) U.S. Cl. ..... 53/433; 53/442; 53/450; 53/551; 53/545; 53/557

(58) Field of Classification Search ..... 53/416, 53/420, 427, 432–434, 441, 442, 452, 453, 53/467, 469, 473, 476–478, 485, 556, 557, 53/329.2, 329.3, 511, 545, 450, 510; 426/124, 426/129

See application file for complete search history.

(56) References Cited

U.S. PATENT DOCUMENTS 2,376,583 A 5/1945 de Poix et al.

(Continued)

FOREIGN PATENT DOCUMENTS

DE 11 45 087 3/1963

(Continued)

OTHER PUBLICATIONS

Parts of Russian book, "Plastics Packaging and Package", 1980.

(Continued)

*Primary Examiner*—Luan K Bui
(74) *Attorney, Agent, or Firm*—McDonnell Boehnen Hulbert & Berghoff LLP

(57) ABSTRACT

A method for packaging a good by means of a package formed of a shrinkable lower film 7 and an upper film 10 is provided. The lower film may be deep-drawn to form a container for accommodating the good, and after filling in the good, an upper film may be supplied for covering. The such-formed package is sealed and then may be subjected to shrinking in an evacuating and sealing station. Consecutively to the evacuating and sealing, an additional shrinking may be performed by subjecting the package to heat from all sides, so as to remove the film section having developed between the part of the lower and the upper film directly resting against the good and the sealing rim 16. A corresponding device for executing the method is indicated.

10 Claims, 7 Drawing Sheets

U.S. PATENT DOCUMENTS

| | | | | |
|---|---|---|---|---|
| 3,956,867 | A | 5/1976 | Utz et al. | |
| 4,137,688 | A | 2/1979 | Utz et al. | |
| 4,366,663 | A | 1/1983 | Grebe | |
| 4,420,516 | A | 12/1983 | Ermert et al. | |
| 4,471,599 | A | 9/1984 | Mugnai | |
| 4,567,713 | A | 2/1986 | Natterer | |
| 4,676,049 | A | 6/1987 | Wallter et al. | |
| 4,796,408 | A | 1/1989 | Mobark | |
| 6,282,866 | B1 | 9/2001 | Natterer et al. | |
| 6,408,598 | B1 * | 6/2002 | Stockley, III | 53/433 |
| 7,237,371 | B2 * | 7/2007 | Yamamoto et al. | 53/433 |
| 2003/0196412 | A1 * | 10/2003 | Foulke, Jr. | 53/432 |

FOREIGN PATENT DOCUMENTS

| | | | | |
|---|---|---|---|---|
| DE | 22 59 547 | | 6/1974 | |
| DE | 23 64 565 | A1 | 7/1975 | |
| DE | 32 15 436 | C2 | 5/1984 | |
| EP | 0 062 822 | A | 10/1982 | |
| EP | 0 127 016 | A2 | 5/1984 | |
| EP | 0 569 937 | A | 11/1993 | |
| EP | 0 569 937 | B1 | 11/1993 | |
| EP | 1 038 773 | B1 | 8/2000 | |
| GB | 2 119 341 | A1 | 11/1983 | |
| GB | 2119341 | * | 11/1983 | 53/433 |
| JP | 54-083593 | | 7/1979 | |
| JP | 60 110 612 | | 6/1985 | |
| JP | 4-32902 | | 3/1992 | |
| KR | 1996-0004347 | | 4/1996 | |
| SU | 1 676 932 | A1 | 9/1991 | |

OTHER PUBLICATIONS

Journal "Die Fleischeri" Nov. 1983, pp. 942-944.
Dixie Skin, First Class. The Second Skin., CFS Lifecycle Performance, Dixie Union Packaging Systems.
J.C. Ferey, Skin Packaging For Optimum Skin Protection, Dec. 1, 1987.
Extruding Tubular Films, VDI-Verlag GmbH, 1973.
Partial translation of JP4-32902 submitted herewith, 1 page.
Partial translation of JP54-83593 submitted herewith, 1 page.

* cited by examiner

METHOD AND DEVICE FOR PACKAGING

FIELD OF THE INVENTION

The invention relates to a method for packaging a good in a shrink package as well as to a device for executing the method and to a package made of shrinkable film.

BACKGROUND AND SUMMARY OF THE INVENTION

The method and the device disclosed herein serve to package perishable food such as meat products. The problem occurring with some prior methods and devices is that liquid may leak out during the time of storage and ripening, deteriorating the storage life by an enhanced growth of germs in the liquid.

In practice, in a simple case, meat pieces are placed in an appropriate film bag and evacuated and sealed in a vacuum chamber machine. Since the bags are always bigger than the products, excessive film remains and creases can develop. When using a shrinkable film, the wrapping is shrunk by a subsequent heat wrapping on the package and a skin-tight fitting of the film is attained. A disadvantage of this method of packaging is the high personnel costs. A further kind of packaging is the so-called vacuum deep-drawing packaging, as it is known from DE-A-2 364 565. Here, trays in which the product to be packaged is placed are formed from a lower film layer. The so-filled container is brought into a vacuum chamber together with a covering upper film layer and is evacuated and sealed there. In the chamber, the tray formed of the lower film is subjected to heat, whereby shrinking forces are released leading to the lower film nestling to the good to be packaged. A package formed in this way is shown in FIG. 6. It has the disadvantage that the lower film and the upper film are in contact with each other without being sealed together in a region between the product and the sealing rim, and that creases exist in the region in which the lower film and the upper film are in contact. In the course of the time of ripening, meat liquid enters into this non-sealed section between the lower film and the upper film.

From EP-A-127 016, a method is known in which the heating for the purpose of shrinking of the deep-draw package is effected by vapor. Here, the same disadvantages are present as in the package described above.

It is an object of the invention to provide a method and a device as well as a package enabling a long storage life of food such as meat, wherein, for marketing, the package shall have an appealing appearance.

This object is solved by the method described in claim 1, the device described in claim 6 and the package described in claim 9.

BRIEF DESCRIPTION OF THE DRAWINGS

Further features and advantages of the invention will arise from the description of embodiments with reference to the figures, wherein.

DETAILED DESCRIPTION OF EMBODIMENTS OF THE INVENTION

Figure 1:
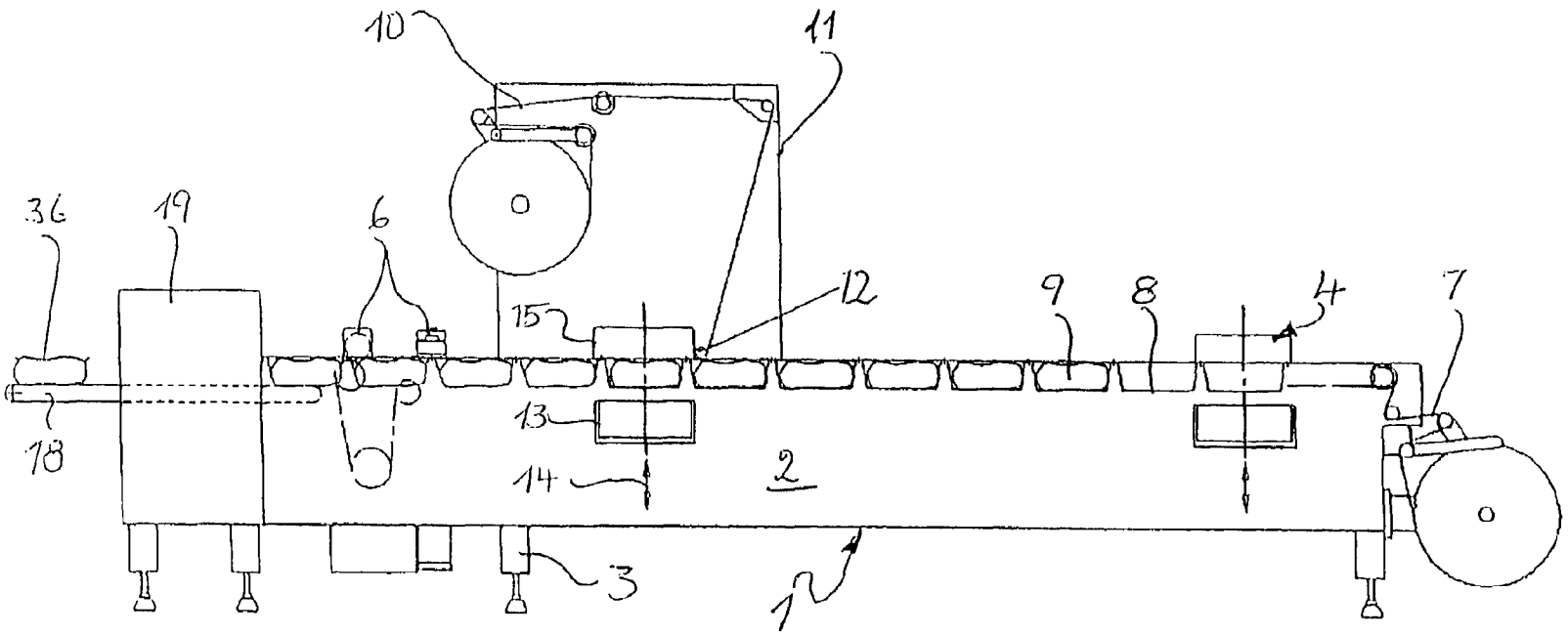
FIG. 1 shows a schematic side view of a packaging machine with the side wall omitted.

As can best be seen in FIG. 1, the packaging machine includes a frame 1 having a side wall 2 and feet 3 supporting the same. The frame supports a forming or deep-drawing station 4 and an evacuating and sealing station 5, consecutively arranged from the input side in direction towards the output side.

As can be seen in FIG. 1, a supply for a lower film 7 is provided on the input side. This lower film is guided through the stations from the input side to the end on the output side. In the side walls circulating strands of chains are provided for guiding each, laterally gripping the supplied lower film at the input side and guiding it to the output side while maintaining it in a preselectable prestressed condition.

In the forming station 4 a forming of containers 8 is effected by deep-drawing in a known manner. These are filled with the good 9 to be packaged subsequent to the forming station.

As can be seen in FIG. 1, the frame comprises an attachment 11 supporting a reel of upper film 10. The upper film 10 is supplied to the upper side of lower film 7 via corresponding pulleys from the input to the evacuating and sealing station 5 to virtually form a cover for the containers 8. The lower film 7 and the upper film 10 supplied here, are both provided as a shrinking film.

Figure 6:
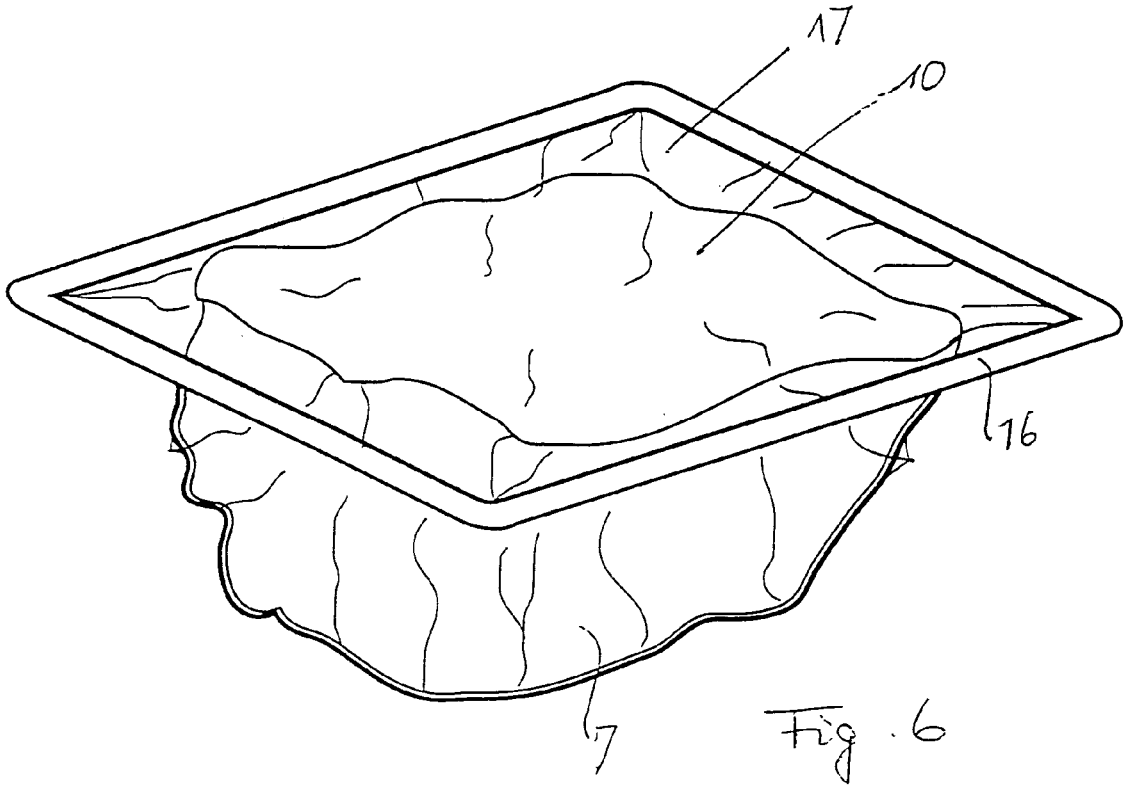
FIG. 6 shows an illustration of a known package.

The evacuating and sealing station 5 is formed such that a lower part 13 is moved toward an upper part 15 in the direction of the arrow 14 to hermetically close the station. In the manner known from the above mentioned DE-A-2 364 565, evacuating, sealing and closing of the shrinkable lower film to the good to be packaged is performed. As can be seen in FIG. 6, the such-formed package comprises a sealing rim 16 and the section of the shrunk lower film 7 and the upper film 10 which is tightly enclosing the good to be packaged. Furthermore, between the film sections contacting the good and the sealing rim 16 a section 17 exists in which the lower film 7 and the upper film 10 tightly contact each other without being fused together.

In the cutting device 6 arranged subsequently, the thus-formed containers shown in FIG. 6 are cut out from the film layer by transverse and longitudinal cutting and are placed on a conveyor belt 18.

Figure 7:
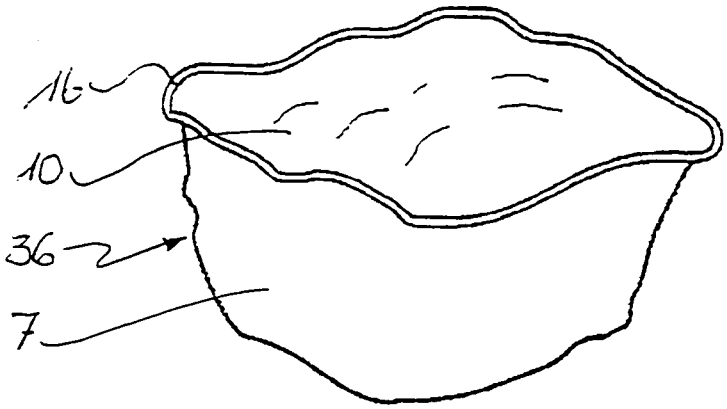
FIG. 7 shows a first embodiment of a package in accordance with the invention.

In the embodiment shown, the packaging machine has an additional shrinking apparatus 19 which is only schematically depicted on its output side. The additional shrinking apparatus is formed such, that a package of the kind shown in FIG. 6 which is supplied, is subjected to heat from all sides to result in an additional shrinking of the lower film 7 and the upper film 10, such that the section 17 vanishes by shrinking and the such-formed package 36 adopts the appearance shown in FIG. 7. As a result, the lower film 7 and the upper film 10 fully contact the good to be packaged and the section 17 no longer exists.

On the one hand, the additional shrinking apparatus 19 may be formed to shortly expose the package to water having a temperature below the boiling point. By the heated water, an intense and fast shrinking is performed without adversely affecting the product by the heat. Alternatively, the apparatus 19 may provide for rinsing the free package with heated air.

Figure 2:
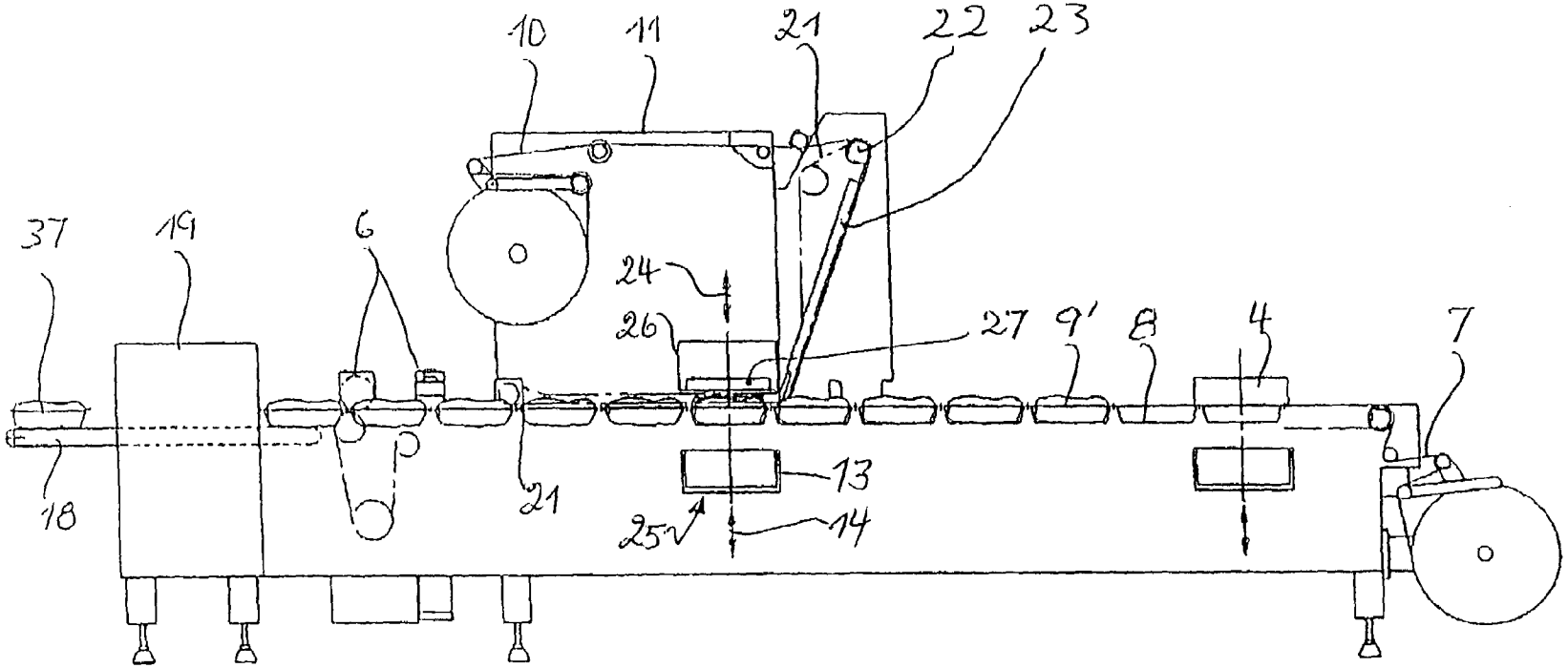
FIG. 2 shows a corresponding illustration of a modified embodiment.

The embodiment shown in FIG. 2 is modified in such a manner that the good 9' can be packaged which projects above the plane of the lower film after being filled in the deep-drawn container 8 as shown in FIG. 2. The parts corresponding to each other are provided with identical reference numerals. The main difference consists in the supply of the upper film 10 and in the construction of the evacuating and sealing station 25.

As shown in FIG. 2, on both sides of the upper film, a circulating strand of chain 21 supported by the attachment 11 is provided which, guided via a pulley 22 at a distance from the input side of the evacuating and sealing station 25, laterally grips the upper film 10 and guides the held upper film 10 through the evacuating and sealing station 25 and which releases it at a distance downstream of the evacuating and sealing station 25. In the section between the pulley 22 and the input side of the evacuating and sealing station 25, a heating apparatus 23 is provided subjecting the upper film 10 to heat. This may be formed as a contact heating area or as a radiation heating area.

The evacuating and sealing station 25 has an upper part 26 provided in the lower part 13 already described and being also movable in a reciprocating manner in the direction of an arrow 24. On its side facing the lower part 13, the upper part 26 has a cavity 27 inside, large enough to accommodate the part of the good 9' to be packaged which projects above the plane of the lower film.

Figure 8:
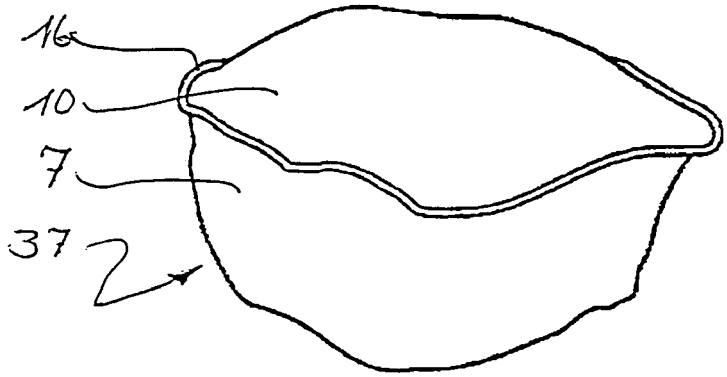
FIG. 8 shows a second embodiment of a package in accordance with the invention.

When operated, for supply, the two parts 13 and 26 are held in the position shown in FIG. 2 separated from each other so that the filled package with the upper and the lower film is insertable. Then, the two parts are brought together such that the contact area is in the plane of the lower film and that the edges of the lower film and the upper film are held upon each other. In this way, in the evacuating and sealing station a stretching of the upper film enabled by the pre-heating takes place. Here, like in the first embodiment, the shrinking onto the good is performed for the lower film as well as for the upper film. As in the case of the embodiment described first, an additional shrinking is performed in the additional shrinking apparatus 19 and in consequence the formed package 37 adopts the appearance as shown in FIG. 8, i.e. the package section 17 initially existent between the product region and rim 16 vanishes.

Figure 3:
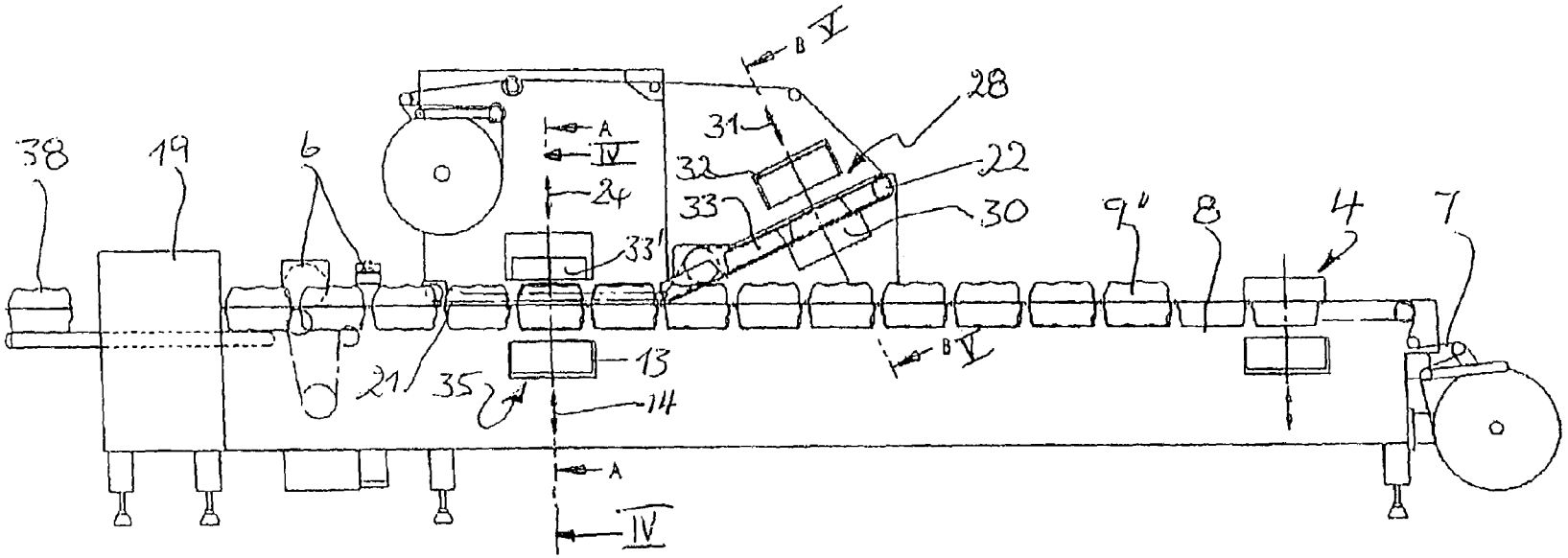
FIG. 3 shows a corresponding illustration of a further modified embodiment.

The embodiment shown in FIG. 3 is formed to accommodate good 9" to be packaged. As shown in FIG. 3, this good considerably projects above the plane of the lower film 7.

An additional forming station 28 is provided in the section between the pulley 22 and the input side of the evacuating and sealing station 35, thus in the region in which the heating apparatus 23 is provided in the second embodiment. On the side of the upper film plane facing the good to be packaged it has a stationary part 30 corresponding to the upper part of the forming station 4 and, on the opposite side of the film plane 1, it has an upper part 32 reciprocating in the direction of the arrow 31. The upper part corresponds to the lower part of the forming station 4. The forming station 28 functions in the same way as the forming station 4 and generates a container part 33 projecting upward above the projecting product by deep-drawing.

The evacuating and sealing station 35 differs from the station described in FIG. 2 in that the cavity 33' has a size appropriate for accommodating the container part 33.

Figure 9:
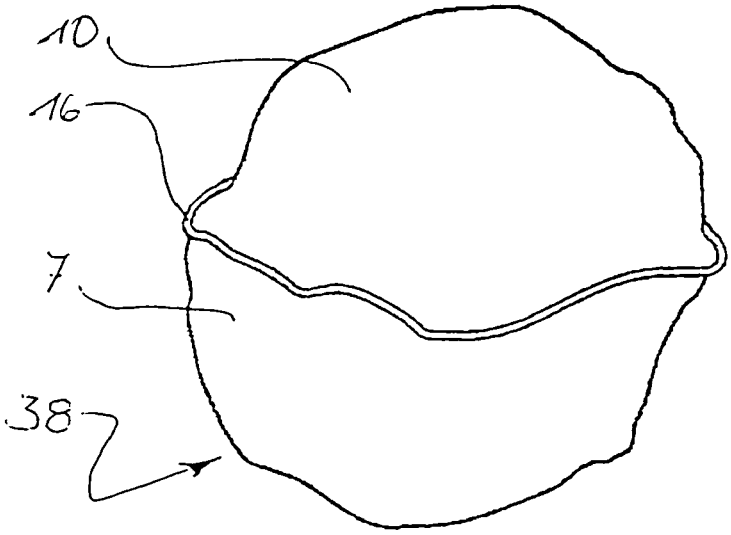
FIG. 9 shows a third embodiment of a package in accordance with the invention.

In operation, the good 9" to be packed is inserted into the containers in the lower film downstream of the forming station 4. Upstream of the evacuating and sealing station 35, the upper film deep-drawn to the opposite direction is placed on the product and the thus-prepared package is fed into the evacuating and sealing station 35 and is evacuated, sealed and shrunk in the above-described way. Subsequently, separation is performed in the above-described way. Again, in the additional shrinking apparatus 19, the additional shrinking is performed having the consequence of attaining a package 38 as shown in FIG. 9 in which again section 17 between the film directly contacting the product and the rim is shrunk away.

In the above described embodiments, the additional shrinking apparatus 19 is in each case provided directly on the output side of the packaging machine. It is also possible to provide the additional shrinking apparatus 19 separated from the packaging machine, to transport the packages released by the cutting device 6 on the output side to the separately provided additional shrinking apparatus 19 provided and to perform the additional shrinking operation there. However, preferably the additional shrinking apparatus 19 is a component of the packaging machine.

Figure 4:
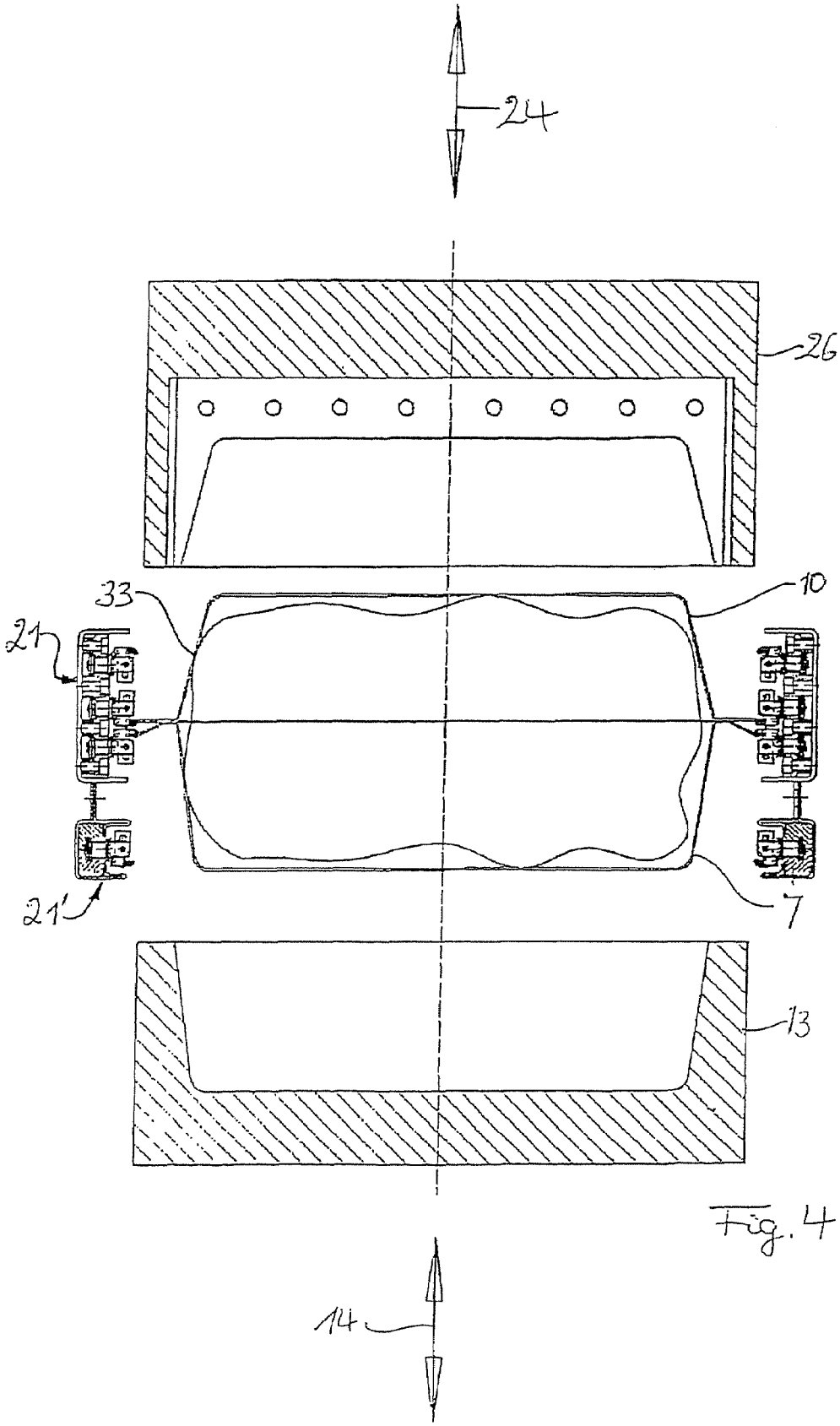
FIG. 4 shows a sectional view along the line IV-IV of FIG. 3.

The strand of chain 21" transporting the lower film layer 7 and the strand of chain 21 transporting the upper film layer holding the edge of lower film and upper film brought together in the position in the evacuating and sealing station 25 and 35, respectively, are illustrated in FIG. 4.

Figure 5:
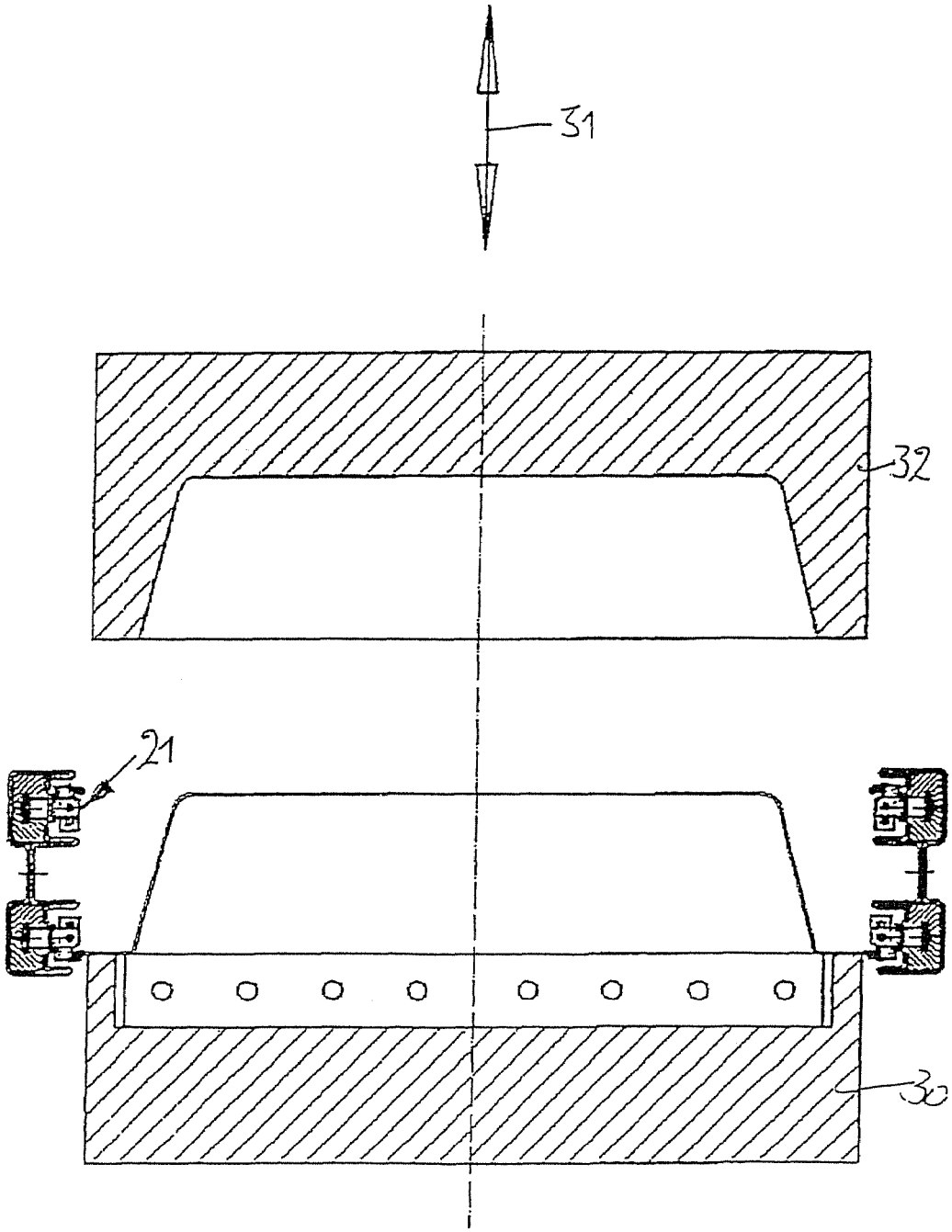
FIG. 5 shows a sectional view along the line V-V of FIG. 3.

In the illustration shown in FIG. 5, the strand of chain in the forming station 28 is shown in which the upper film is guided in the plane of the lower part 30 while being laterally clamped.

In the case of the good to be packaged having cavities as in case of cheese or poultry, for example, the evacuating and sealing station may be respectively formed in a known manner so as to supply an inert gas for filling the cavities in the product after evacuating.

What is claimed is:

1. A method for packaging a good by means of a package formed of a shrinkable lower film and a shrinkable upper film, the method comprising the steps of:

deep-drawing the lower film to form a container for accommodating the good;

placing the good into the container, supplying the upper film above the filled container and covering the filled container and covering the filled container with the upper film, evacuating and sealing the covered container along a rim, releasing said rim, and subjecting the formed package to heat from all sides for all-side shrinking.

2. The method for packaging a good according to claim 1, wherein the upper film is supplied in a pre-stressed condition.

3. The method for packaging a good according to claim 1, wherein the upper film is heated before it is supplied above the filled container.

4. The method for packaging a good according to claim 1, wherein the upper film is deep-drawn before being supplied above the filled container.

5. The method for packaging a good according to claim 1, wherein after evacuating and before sealing an inert gas is supplied for filling cavities present in the good.

6. A method for packaging a good by means of a package formed of a shrinkable lower film and a shrinkable upper film, the method comprising the steps of:

providing a device for packaging a good, having an input side and an output side, an apparatus for laterally gripping and guiding the lower film to be supplied from the input side to the output side, a forming station arranged on the input side for forming containers, an evacuating and sealing station, an apparatus for supplying the upper film to the input side of the evacuating and sealing station, a separating station at the output side and a heating station for subjecting the package to heat from all sides for shrinking; and placing the good into the container;

supplying the upper film above the filled container and covering the filled container with the upper film;

evacuating and sealing the covered container along a rim, releasing said rim; and subjecting the formed package to heat from all sides for all-side shrinking.

7. The method of claim 6, further comprising providing a lateral guide apparatus for laterally guiding the upper film.

8. The method of claim 6, further comprising providing a heating apparatus for heating the upper film.

9. The method of claim 6, further comprising a forming station for forming the upper film, the forming station being positioned upstream of the evacuating and sealing station.

10. The package made by the method of claim 6.

* * * * *